US005996799A

United States Patent [19]

Garreth et al.

[11] Patent Number: 5,996,799

[45] Date of Patent: Dec. 7, 1999

[54] SHIPPING CONTAINER AND METHOD

[75] Inventors: Ralph H. Garreth, Oklahoma City, Okla.; Barry E. Johnston, McDonald, Pa.

[73] Assignee: Exakt Technologies, Inc., Oklahoma City, Okla.

[21] Appl. No.: 09/010,661

[22] Filed: Jan. 22, 1998

[51] Int. Cl.[6] ..... B65D 85/84

[52] U.S. Cl. ..... 206/521; 206/524.5; 206/524.6

[58] Field of Search ..... 206/524.4, 524.5, 206/524.6, 524.1, 521, 569

[56] References Cited

U.S. PATENT DOCUMENTS

| | | | |
|---|---|---|---|
| 2,065,293 | 12/1936 | Scudder | 220/63 |
| 2,369,765 | 2/1945 | Waters | 99/186 |
| 2,679,336 | 5/1954 | Frick | 222/209 |
| 2,872,760 | 2/1959 | Meissner | 53/20 |
| 3,138,248 | 6/1964 | Abbott | 206/46 |
| 3,153,886 | 10/1964 | Christensson | 53/22 |
| 3,203,551 | 8/1965 | Van Loan, Jr. | 210/486 |
| 3,275,053 | 9/1966 | Kabana | 150/42 |
| 3,443,735 | 5/1969 | Meijers | 229/14 |
| 3,450,254 | 6/1969 | Miles | 206/46 |
| 3,610,455 | 10/1971 | Greenhalgh et al. | 215/12 |
| 3,621,994 | 11/1971 | Brown | 206/65 R |
| 3,761,013 | 9/1973 | Schuster | 229/62 |
| 3,826,296 | 7/1974 | Morris | 150/3 |
| 3,999,653 | 12/1976 | Haigh et al. | 206/584 |
| 4,155,453 | 5/1979 | Ono | 206/522 |
| 4,190,158 | 2/1980 | Ambrose | 206/522 |
| 4,193,518 | 3/1980 | Holmes | 222/105 |
| 4,205,750 | 6/1980 | Dews | 206/534 |
| 4,306,653 | 12/1981 | Fales | 206/326 |
| 4,421,150 | 12/1983 | Masters | 383/61 |
| 4,434,893 | 3/1984 | Barlow | 206/522 |
| 4,459,793 | 7/1984 | Zenger | 53/434 |
| 4,466,553 | 8/1984 | Zenger | 220/461 |

(List continued on next page.)

OTHER PUBLICATIONS

"STP 370 —Packaging system suitable for safe legal transport of any infectious substance, on dry ice by any mode.", SAF–T–PAK, Inc., Edmonton Alberta Canada. (pre Jan. 22, 1997).

Labelmaster Industrial Compliance Products 1994 General Catalog.

A sketch showing an infectious substance packaging from All–Pak, Inc. It comprises a corrugated case, polystyrene pads, plastic bag and tie, metal can with metal overcap and tape, cellulose pads/cushioning, and 16–ounce plastic container. (pre Jan. 22, 1997).

"Laboratory Equipment —News of Products, Supplies & Services," dated Aug. 1993, showing hazardous materials packaging from Qorpak.

Polyfoam Packers Corporation publication entitled "Certified, Economical Packaging for Infectious Substances" (Form No. 14761G4); (pre Jan. 22, 1997).

Polyfoam Packers Corporation publication entitled "ThermoSafe® FreezSafe® Insulated Containers." (pre Jan. 22, 1997).

*Primary Examiner*—Jacob K. Ackun
*Attorney, Agent, or Firm*—McAfee & Taft

[57] ABSTRACT

A multi-component container has a non-rigid, durable, flexible design constructed with a tough outer bag having specifically located fastenings. The outer bag when assembled with the fastenings constrains an inner bladder that is a durable, flexible, sealable leakproof bag having dimensions selected relative to the outer bag. The combination of the inner and outer components enable the container to meet or exceed national and international testing criteria applicable to the transport of many hazardous items in accordance with applicable regulations. A related method of transporting is also disclosed.

43 Claims, 4 Drawing Sheets

U.S. PATENT DOCUMENTS

| | | | |
|---|---|---|---|
| 4,560,069 | 12/1985 | Simon | 206/591 |
| 4,569,082 | 2/1986 | Ainsworth et al. | 383/3 |
| 4,640,080 | 2/1987 | Wright | 53/449 |
| 4,679,688 | 7/1987 | Söderhold et al. | 206/204 |
| 4,681,839 | 7/1987 | Swartz | 435/1 |
| 4,869,398 | 9/1989 | Colvin et al. | 222/83 |
| 4,880,119 | 11/1989 | Simon | 206/584 |
| 4,882,893 | 11/1989 | Spencer et al. | 53/449 |
| 4,913,700 | 4/1990 | Kantrowitz et al. | 604/93 |
| 4,968,624 | 11/1990 | Bacehowski et al. | 435/287 |
| 4,969,750 | 11/1990 | Russo et al. | 383/113 |
| 4,972,945 | 11/1990 | Insley et al. | 206/204 |
| 5,035,104 | 7/1991 | Helling et al. | 53/441 |
| 5,040,678 | 8/1991 | Lenmark, Sr. et al. | 206/443 |
| 5,041,046 | 8/1991 | Nakamura et al. | 446/220 |
| 5,096,062 | 3/1992 | Burkardt et al. | 206/361 |
| 5,150,971 | 9/1992 | Strong et al. | 383/84 |
| 5,155,039 | 10/1992 | Chrisope et al. | 435/243 |
| 5,160,021 | 11/1992 | Sibley et al. | 206/204 |
| 5,167,344 | 12/1992 | Van Schilt | 220/657 |
| 5,174,464 | 12/1992 | Watt | 220/256 |
| 5,193,677 | 3/1993 | Moreno | 206/315.1 |
| 5,199,795 | 4/1993 | Russo et al. | 383/113 |
| 5,230,566 | 7/1993 | Jackson et al. | 383/66 |
| 5,236,088 | 8/1993 | Dhority et al. | 206/438 |
| 5,261,551 | 11/1993 | Watt | 220/256 |
| 5,265,960 | 11/1993 | Shikler | 383/15 |
| 5,328,028 | 7/1994 | Hale et al. | 206/366 |
| 5,358,142 | 10/1994 | Holmes | 222/1 |
| 5,427,238 | 6/1995 | Weiss | 206/366 |
| 5,462,171 | 10/1995 | Moog et al. | 206/592 |
| 5,487,470 | 1/1996 | Pharo | 206/522 |
| 5,509,255 | 4/1996 | Rutledge | 53/449 |
| 5,603,401 | 2/1997 | Brunner | 206/204 |

SHIPPING CONTAINER AND METHOD

BACKGROUND OF THE INVENTION

This invention relates generally to hand-portable, durable, non-rigid shipping containers and related methods of transporting, particularly containers and methods suitable for transporting relatively small sizes or quantities of hazardous items such as medical diagnostic specimens, biological materials, and infectious substances by conventional private or public carriers.

Something removed from a human or other animal may need to be transferred from the place of extraction to a place where it can be analyzed. For example, a surgically removed hip prosthesis may need to be returned to the manufacturer for analysis or it may need to be sent to a laboratory where human tissue on the prosthesis is to be analyzed. When the sending and receiving places are distant, the substance may need to be shipped via a private or public carrier. Such transportation can be via land (road or rail), sea or air (passenger or cargo craft).

It will be readily appreciated that shipping such a specimen poses a significant health risk if the specimen contains an infectious or potentially infectious substance and it is not adequately packaged. There are many regulations, from local governmental to international regulations, seeking to define safe shipping standards. Pertinent federal regulations in the United States include those set forth in titles 29, 39, 42 and 49 of the Code of Federal Regulations. Examples of particular agencies concerned with safe packaging and shipping standards are the International Civil Aviation Organization/International Air Transport Association (ICAO/IATA), United States Department of Transportation (DOT), U.S. Center of Disease Control (CDC), U.S. Occupational Safety and Health Administration (OSHA), United Nations (UN), and World Health Organization (WHO). Specific pertinent standards include:

1. Dangerous Goods Regulations International Air Transport Association 38th Edition, Jan. 1, 1997
2. Code of Federal Regulations (CFR) Title 49—Transportation Subtitle B—Other Regulations Relating to Transportation U.S. Dept. of Transportation Parts 172, 173, 176 and 178 Oct. 1, 1996
3. Biosafety in Microbiological and Biomedical Laboratories U.S. Dept. of Health and Human Services Public Health Service (CDC and NIH) 3rd Edition May, 1993
4. Code of Federal Regulations (CFR) Title 42—Public Health U.S. Dept. of Health and Human Services Part 72 Interstate Shipment of Etiologic Agents Mar. 2, 1995
5. Hazardous Material Regulations Transportation Safety Act of 1974 Consolidation of 1976 Pocket Guide, 1991
6. U.S. Dept. of Health and Human Services Center for Devices and Radiological Health (CDRH) U.S. Food and Drug Administration (FDA) Generic Standard Operating Procedure "Handling, Packaging, Transportation, Storage and Sterilization of Medical Devices".

October, 1994

7. U.S. Dept. of Health and Human Services Occupational Safety and Health Administration (OSHA) Section 3—Final Rules on Occupational Exposure to Bloodborne Pathogens
8. American Society for Testing and Materials (ASTM) Proposed Documents for ISO/TC 150/WG5 "Retrieval and Analysis of Implantable Medical Devices"

9. United Nations Documents Requirements for Transportation of Hazardous Goods

In trying to transport hazardous items in compliance with the foregoing, problems can arise with existing containers with regard to durability, rigidity, size, weight, cost, reusability, and cost of refurbishment. These issues are especially significant when the containers are required to be leakproof and pressure resistant. Durability problems exist with rigid containers due to the inevitable bangs, scrapes, dents and other permanent distortions that can occur in containers during handling and transport. Durability can also be adversely affected by external environmental conditions. These potential problems can bring about a loss of integrity in the container. In some cases, a container cannot be reused due to its lack of durability or because it was designed for one use only. If the container is reusable, it may have to undergo an expensive process to refurbish the container for reuse in order to meet original specifications, performance criteria and regulations. Another problem that exists is that performance certified containers can be very large in comparison to the material or specimens to be transported, thereby creating unnecessary cost of the container and increased cost of transportation. Also, the lack of ability to match a performance oriented container size to the size of the materials/specimen can cause the transport to be unwieldy, heavier than necessary, difficult to store and too large for its intended purpose. Furthermore, there are containers which do not even meet the criteria of performance testing for hazardous materials.

In view of the foregoing, there is a particular need for a shipping container and related method which can transport hazardous items that are in the solid or solid plus liquid forms and that have irregular shapes, odd size dimensions or are cumbersome. Such a container and method preferably should meet both general and specific requirements and testing protocols of national and international regulations for modes of transportation to include air, sea, rail and highway. Such a container should be durable, lightweight, flexible and reusable. The foregoing especially includes the capability of transporting hazardous items in a leakproof, pressure resistant, vibration resistant container that meets all applicable criteria. Types of substances which such a container and method should accommodate include, but are not limited to, pathogens, bacteria, blood, modified organisms, contaminants, infectious substances, compounds, chemicals, toxins and vaccines.

SUMMARY OF THE INVENTION

The present invention overcomes the above-noted and other shortcomings of the prior art, and meets the aforementioned and other needs, by providing a novel and improved shipping container and method of transporting.

Specific implementations of the present invention are intended to meet national and international regulatory performance test criteria for the transport of many hazardous materials and specimens in a solid or liquid state. Items such as used medical instruments, retrieved implanted medical devices, toxic soil samples, contaminated metallurgical specimens, blood bags, soft and hard tissue fixed in a number of chemicals are just a few of the items where a need exists for less costly, more efficient transport where odd size and shape have heretofore created problems. More generally, but without limiting other uses of the present invention, the present invention is especially intended for use with at least some of the hazardous items covered by hazard classes 3, 4, 5, 6, 8 and 9.

The invention provides a multi-component non-rigid shipping container that is flexible to accommodate the particular item or items to be transported. The container can be sized to specific sizes and shapes of the item(s) to be transported. This allows for a smaller, less cumbersome, reduced weight container that costs less, is easier to handle, and takes less space to store. The container's non-rigid, flexible design enhances its durability, possibly reducing damage caused during transport and increasing the probability of reusability. The invention is adaptable to have a closer net shape of the item(s) to be transported. Material selection of the container allows the container to be significantly more resistant to external environmental conditions without compromising container integrity. Reusability is accomplished with the replacement of one or two components having relatively low cost. The present invention therefore provides a less costly, yet durable, flexible, non-rigid, reusable container which meets regulatory criteria for transporting hazardous materials and specimens. The present invention also provides a related method of transporting.

In one embodiment, the shipping container is a pressure resistant shipping container which comprises an outer bag having a cavity defined therein with the cavity having a length and a width related to an area in which to receive an item to be shipped. This container further comprises an inner bag having a length not less than the length of the cavity of the outer bag. The inner bag also has a width not less than the width of the cavity of the outer bag. The inner bag is adapted to receive an item to be shipped, and the outer bag is adapted to receive into the cavity the inner bag and the item received therein to form the pressure resistant shipping container.

In another embodiment, the shipping container comprises a flat pouch defining a cavity accessible through a mouth defined in the pouch, the pouch being made of a flexible material which permits the pouch to change shape in response to the shape of an item received in the cavity of the pouch. This container further comprises a fold retainer apparatus connected to the pouch such that the fold retainer apparatus retains the pouch in a folded condition at a fold line spaced from the mouth of the cavity when the portion of the pouch having the mouth is folded back over an adjacent portion of the pouch. This container still further comprises an inner bag adapted to receive the item and to be received in the cavity of the pouch below the fold line. This container also preferably comprises a fold and mouth retainer apparatus connected to the pouch such that the fold and mouth retainer apparatus retains the pouch in the folded condition and the mouth in a closed position. The container can also comprise a mouth closure apparatus connected to the pouch at the mouth.

The shipping container can also be defined to comprise a flexible outer bag assembly conformable to an odd shaped hazardous item received in the outer bag assembly, wherein the flexible outer bag assembly has a strength which is not exceeded when the outer bag expands in response to a pressure differential of about 13.8 pounds per square inch from inside the outer bag assembly to outside the outer bag assembly.

The present invention also provides a method of transporting one or more hazardous items. This method comprises: inserting the one or more hazardous items into an inner bag; sealing the inner bag closed; inserting the sealed inner bag through a mouth at one end of an outer bag into a cavity of the outer bag, including moving the inner bag below a fold line at the one end of the outer bag; folding the one end of the outer bag along the fold line such that the mouth is moved adjacent a portion of an outer surface of the outer bag and retaining the outer bag in this folded condition; engaging fasteners connected to the outer bag and extending over the mouth in the folded condition; and shipping the retained, fastened outer bag containing the inner bag and the one or more hazardous items by a public or private carrier. This method can further comprise securing the mouth closed in addition to both retaining the outer bag in the folded condition and engaging the fasteners. This method preferably also comprises using an inner bag having a length and width not less than a length and width of the portion of the cavity below the fold line. This method can further comprise selecting the one or more hazardous items from the group consisting of diagnostic specimens, biological materials, and infectious substances.

Therefore, from the foregoing, it is a general object of the present invention to provide a novel and improved shipping container and method of transporting. Other and further objects, features and advantages of the present invention will be readily apparent to those skilled in the art when the following description of the preferred embodiments is read in conjunction with the accompanying drawings.

DETAILED DESCRIPTION OF THE INVENTION

Figure 1:
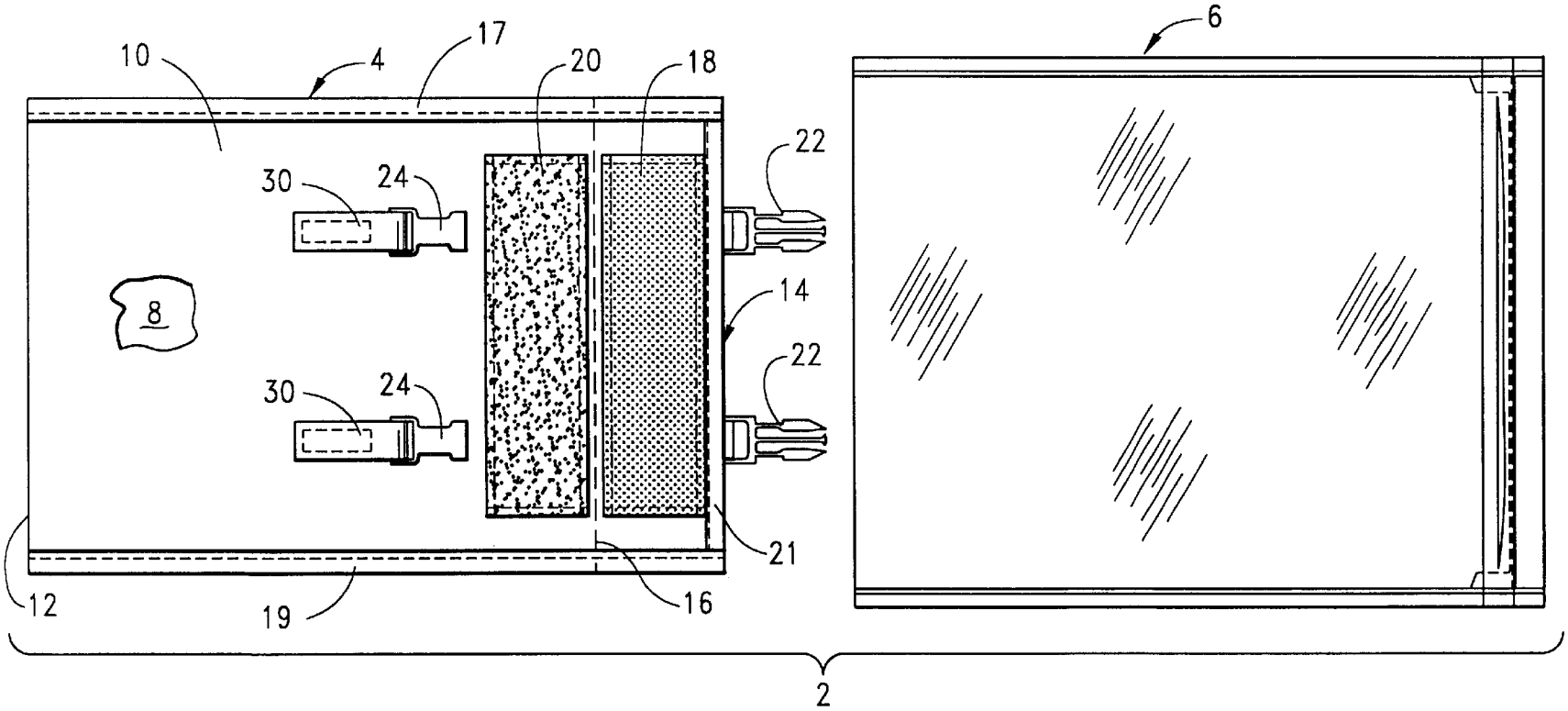
FIG. 1 is an exploded view of a preferred embodiment of a shipping container of the present invention.

The preferred embodiment of the present invention shown in the drawings is a multi-component container 2 comprising a non-rigid, flexible outer bag 4 and an inner bladder bag 6. Various coupling devices are connected to the outer bag 4 to keep it in a closed, shipping-ready configuration. A particular implementation of this embodiment provides a pressure resistant shipping container capable of transporting hazardous items ("item" as used herein and in the claims encompasses whatever may be shipped in the present invention, and includes, but is not necessarily limited to, materials, substances, devices, and specimens, whether hazardous or non-hazardous unless otherwise specified). The product of this assembly of components particularly produces a leakproof, pressure resistant container tested and certified to Title 49 C.F.R., Parts 173.27, 196.604, and 196.605. It is capable of transporting diagnostic specimens, biological materials, and infectious substances inside an outer packaging as either a primary container or a secondary container. With an exemption from the United States Department of Transportation, it can function as an outer packaging and a secondary container.

Referring to FIG. 1, the outer bag 4 has a cavity 8. The outer bag 4 has an overall outer length and width, and the cavity itself has a length and a width ("L" and "W" in FIG. 2) related to an area in which to receive an item to be shipped. In a particular implementation, the overall external dimensions are about 18 inches×about 12.5 inches, and the internal dimensions L and W of the cavity related to the area in which to receive one or more items for shipment are about 15 inches×about 12 inches.

Figure 2:
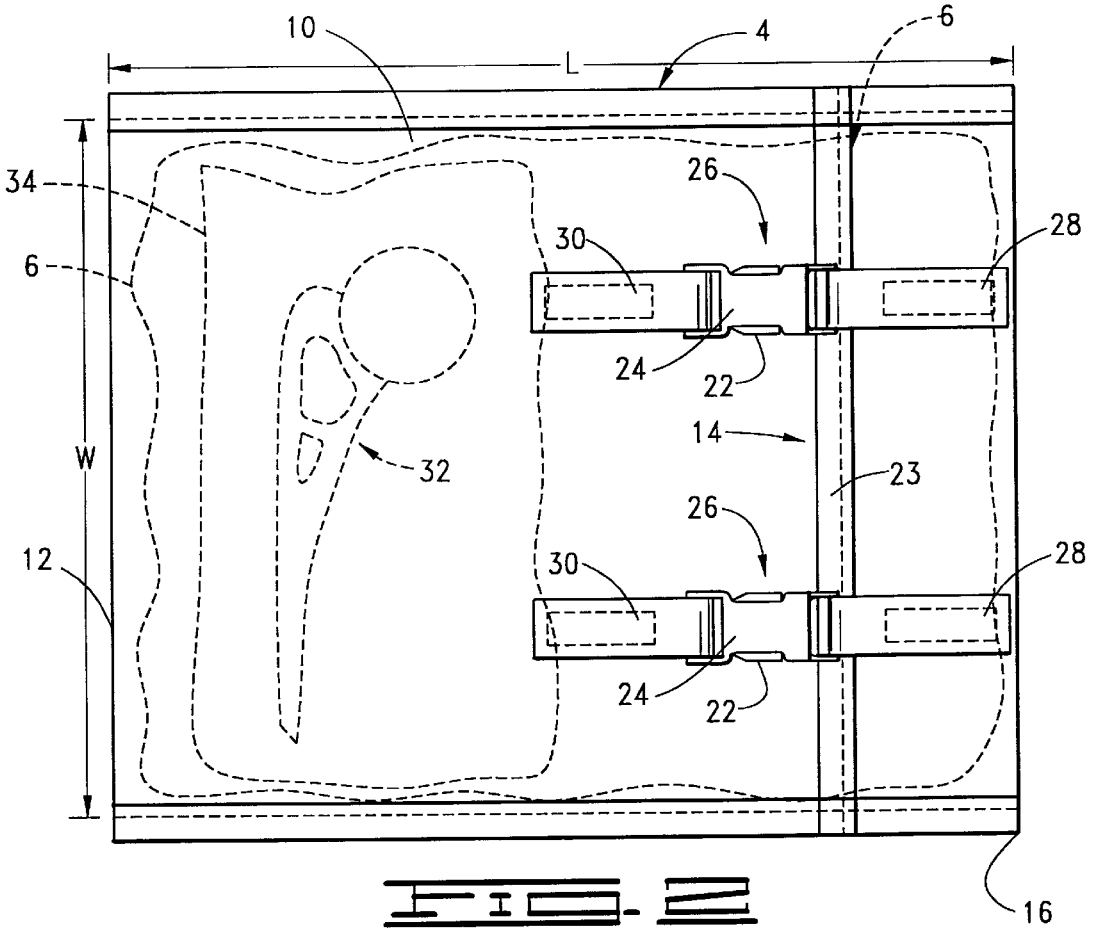
FIG. 2 is an external plan view of the shipping container of FIG. 1 with an inner bag inside an outer bag which is shown in a closed and shipping-ready condition.
Figure 3:
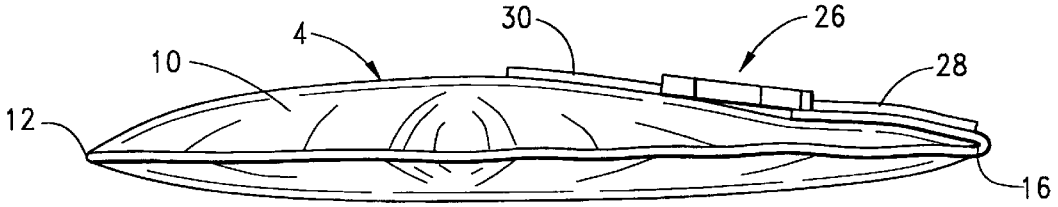
FIG. 3 is an external side view of the shipping container shown in FIG. 2.

As illustrated in the drawings, the outer bag 4 is a flat pouch formed by folding a sheet 10 (FIGS. 4 and 5) of flexible material along a line to define an integral closed edge 12 (FIGS. 1–3 and securing the folded sheet 10 (such as by sewing or other suitable technique) along edges extending from the integral closed edge 12 to a mouth 14 (FIG. 1) providing an opening into the cavity of the outer bag 4. The flexible material of the sheet 10 alone has a desired strength; but particularly with one or more, and preferably all, of its attached closure apparatus described below, the material and these components provide an assembled strength which is not exceeded when expansion of the outer bag 4 occurs in response to a pressure differential of about 13.8 pounds per square inch from inside the cavity 8 to outside the outer bag 4. The flexibility of the material permits the pouch to change shape in response to the shape of the one or more items received in the cavity 8 of the pouch.

The material of the outer bag 4 is preferably tough, strong and durable, yet also suitable for creating a lightweight bag. If the material is secured together by sewing, this can be done with or without a reinforcing piping material for added strength. The material of the outer bag 4 is preferably resistant to corrosion, permeability, softening, premature aging and embrittlement. In a particular implementation, the material is an outer laminated high tensile woven material (e.g., polyester or nylon base cloth with a coating for temperature resistance and additional tear strength). One example of a specific material is Breton Style A-552 from Breton Industries, Inc. of Amsterdam, N.Y.; this material has the following specifications:

| | | |
|---|---|---|
| Base Cloth: Polyester or Nylon | | |
| Weight | | 5.9 oz./yd. |
| Tensile Strength | warp | 300 lbs./in. |
| | fill | 240 lbs./in. |
| Finished Coated Cloth: | | |
| Coating | | Nitrile-Butadiene |
| Weight | | 20 oz./sq. yd. |
| Tear Strength | | 50 lbs./in. |
| Adhesion of Coating | | 20 lbs./2 in. min. |
| Low Temperature Resistant | | |
| Aromatic Hydrocarbon Resistant | | |

In this particular implementation, sewing to hold the folded material 10 together is performed using piping material and nylon thread on two (2) sides such as identified by reference numerals 17, 19 in FIG. 1. Piping material and nylon thread are also used along the edges of the material 10 at the mouth 14 as shown in FIGS. 1 and 2 and marked by the reference numerals 21, 23. The foregoing preferably provides a particular outer bag 4 that is reusable.

The inside of the outer bag can be marked in any suitable manner to indicate where there is to be a fold line below which the inner bag 6 is preferably located before closing the outer bag 4 in the manner described below. It is also desirable for the outside of the outer bag 4 to be markable, such as by silkscreening, for enabling shipping information or other identifying indicia to be placed directly on the outside of the outer bag 4.

The inner bag 6 acts as a bladder which is sealable and leakproof. The inner bag 6 preferably has a length which is not less than (i.e., is equal to or greater than) the length L of the portion of the cavity 8 into which the inner bag 6 is to be received. The inner bag 6 has a width not less than the width W of the relevant portion of the cavity 8. The dimensions of a particular implementation of the sealed inner bag 6 used with the above specific implementation of the outer bag 4 are about 17 inches by about 14.5 inches. Despite this size, the inner bag 6 is adapted to receive the item or items to be shipped and yet be received in the cavity 8 of the pouch below the fold line 16 (see FIG. 2).

The preferred embodiment of the inner bag 6 is as a flat pouch. A particular implementation is a plastic bag with a leakproof limit and elastic limit which withstand a minimum pressure differential such that the bag is leakproof up to at least that pressure. For example, the inner bag 6 can be a leakproof bladder of co-extruded, 3.5 mil plastic which is sealable along one side and has a leakproof limit and an elastic limit that may be exceeded by unconstrained expansion of the bag caused by a pressure differential above about three pounds per square inch from inside the bag to outside the bag (a specific example is a bag made of ARMIN CAB 2 RESIN such as marketed under "VonSeal® Liquid Tight Bag" from Vonco Products, Lake Villa, Ill., and bearing notice of U.S. Pat. No. 4,510,621). Although the inner bag 6 itself is minimally pressure resistant below such a limit, the inner bag 6 as used in the present invention is constrained, in response to the size of the bag 6 relative to the bag 4 and the strength of the assembled outer bag 4, against leakage failure and plastic deformation when expansion is caused in response to a greater pressure differential applied to the assembly (in a particular implementation, preferably a pressure differential of up to 13.8 to 14 pounds per square inch; however, it is contemplated that the present invention can be adapted to perform as desired up to even higher pressure differentials). That is, the outer bag 4 constrains the inner bag 6 of this assembly from expanding to its full size by volume. Consequently, the constrained inner bag 6 is prevented from leaking or reaching its elastic limit or other ultimate strength limit in response simply to the greater pressure applied to the outer bag/inner bag assembly. In this manner, the leakproof inner bag 6 and the more pressure resistant outer bag 4, working in tandem, are capable of meeting or exceeding the leakproof and pressure requirements of 49 C.F.R. 173.27, 178.604, 178.605, 196.604, and 196.605, for example.

Although the outer bag 4 and the inner bag 6 are shown with rectangular shapes, other shapes can be used while complying with the foregoing aspects of the invention.

Once the inner bag 6 is placed inside the outer bag 4, closure of the outer bag 4 is accomplished using three apparatus which provide closure redundancy: a mouth closure apparatus, a fold retainer apparatus, and a fold and mouth retainer apparatus.

Figure 4:
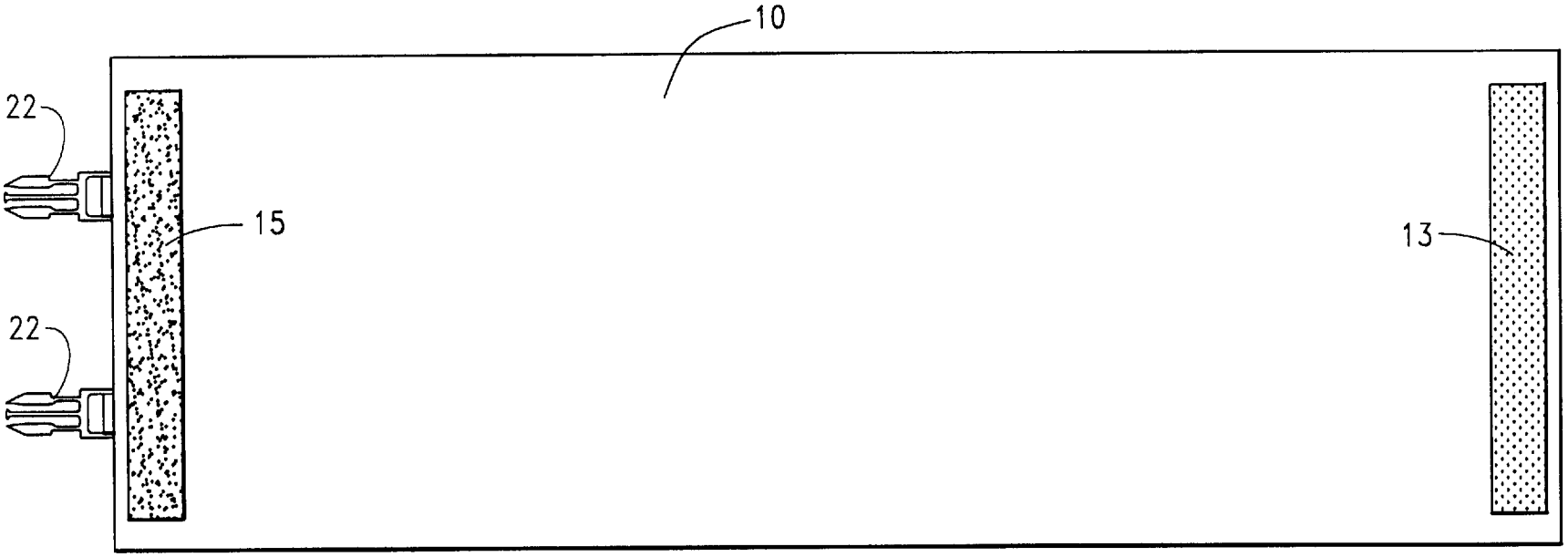
FIG. 4 is an inside layout view of the material, with connected mouth closure apparatus, used to make the embodiment of the outer bag shown in FIGS. 1 and 2.

The mouth closure apparatus is connected to the outer bag 4 at the mouth 14. In the illustrated embodiment and referring to FIG. 4, the mouth closure apparatus includes (1) a hook (or loop) member 13 connected in any suitable manner (e.g., by sewing) to the sheet 10 such that the member 13 will be inside the pouch at a first side of the mouth 14 when the pouch is formed and (2) a complementary loop (or hook) member 15 connected in any suitable manner (e.g., by sewing) to the sheet 10 such that the member 15 will be inside the pouch at a second side of the mouth 14 facing the first side of the mouth and the member 13 when the pouch is made. The pouch is made by folding the sheet 10 along its center line across its width towards the viewer as viewed in FIG. 4 whereby the members 13 and 15 are brought towards each other in a facing manner. Pressing the members 13, 15 together closes the mouth 14 into the cavity 8 and restrains the inner bag 6 from extending outside the outer bag 4. Referring to FIG. 4, in a particular implementation the hook member 13 and the loop member 15 are each approximately one-inch by ten-inch strips centered laterally and spaced about one-fourth inch from the respective ends of the sheet 10.

Figure 5:
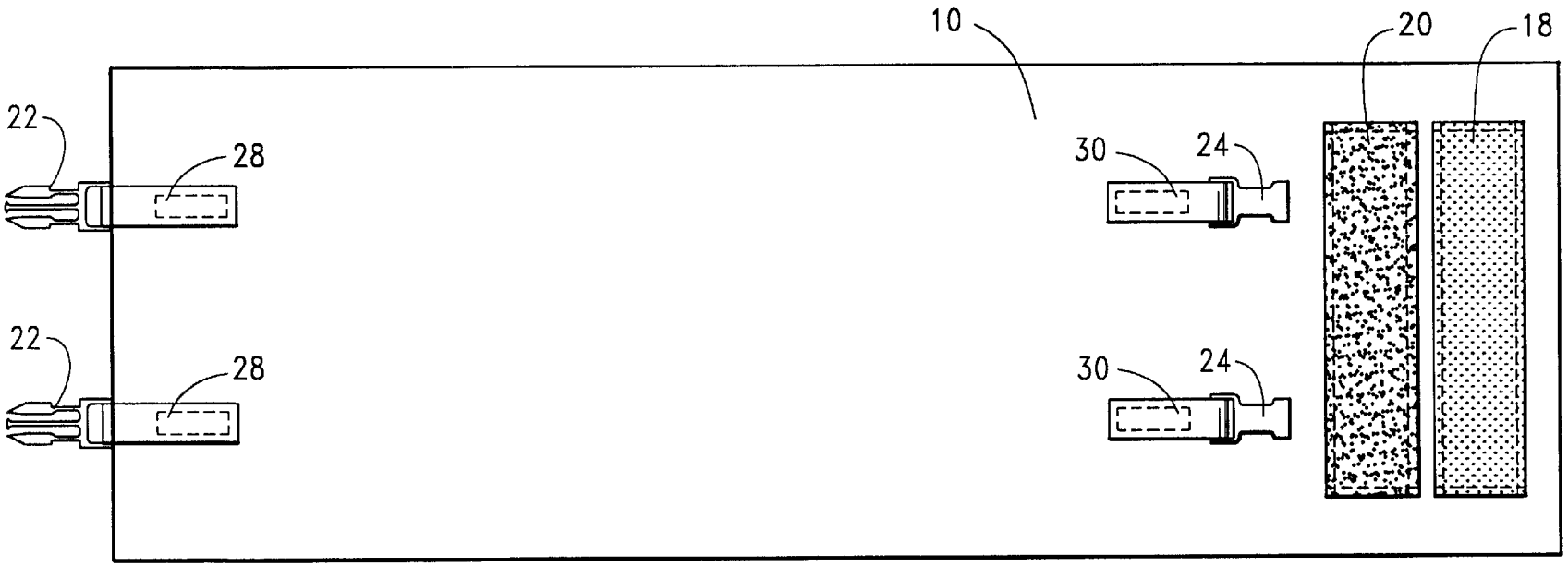
FIG. 5 is an outside layout view of the material, with connected fold retainer apparatus and fold and mouth retainer apparatus, shown in FIG. 4.

The fold retainer apparatus is connected to the outer bag 4 such that the fold retainer apparatus retains the outer bag 4 in a folded condition at a fold line 16 (FIG. 1) spaced from the mouth 14 of the cavity 8 when the portion of the outer bag having the mouth 14 is folded back over an adjacent portion of the outer bag. This folded condition is illustrated in FIGS. 2 and 3. Referring to FIGS. 1 and 5, a section 18 of hook (or loop) material is connected in any suitable manner (e.g., by sewing) to the sheet 10 so that the section 18 is on one of the portions of an outside surface of the outer bag 4 adjacent the fold line 16 when the sheet 10 of FIG. 5 is made into the pouch of FIG. 1. This portion of the outer bag 4 extends from immediately adjacent the mouth 14 to immediately adjacent the fold line 16. The section 18 is coextensive with a majority of the length of the fold line 16. A section 20 of complementary loop (or hook) material is connected in any suitable manner (e.g., by sewing) to the sheet 10 so that the section 20 is on the other of the portions of the outer bag 4 adjacent the fold line 16 when the sheet 10 of FIG. 5 is made into the pouch of FIG. 1. This other portion is on the same outside surface of the pouch as the portion to which the section 18 is connected, but this other portion of the outer bag 4 extends from immediately adjacent the fold line 16 on the side thereof opposite the section 18. The section 20 extends away from the fold line 16 a distance sufficient to engage with the section 18 when the pouch is folded along the fold line 16 such that the mouth 14 is then disposed between the joined sections 18, 20 and the integral closed edge 12 of the pouch as apparent from FIGS. 1 and 2. The section 20 is coextensive with a majority of the length of the fold line 16. This fold retainer apparatus both fastens this folded over portion of the outer bag 4 and keeps the interior space of the outer bag 4 to a specific maximum volume.

In a particular implementation, the sections 18, 20 are each approximately 2.7 inches across measured along the length of the outer bag 4 by approximately ten inches measured along the width of the outer bag 4. Referring to FIG. 5, the section 18 is centered across the width of the sheet 10 and spaced about one-fourth inch from the respective end of the sheet 10. The section 20 is centered across the width of the sheet 10 and spaced about one-fourth inch from the section 18. The fold line 16 is in this space between the sections 18, 20 as shown in FIG. 1. Thus, when the closed end portion of the outer bag 4 is folded over at the fold line 16, this produces the aforementioned approximately 15 inches for the length of the inner bag-receiving portion of the cavity 8 in the particular implementation (which is not limiting of the invention).

The fold and mouth retainer apparatus is connected to the outer bag 4 such that this apparatus retains the outer bag in the aforementioned folded condition and retains the mouth 14 in a closed position. The fold and mouth retainer apparatus includes one or more fasteners connected in any suitable manner (e.g., by sewing) to sheet 10 of the outer bag 4 such that respective members of the fasteners are adapted to be connected together when the outer bag 4 is in the folded condition described above. The fasteners are also connected to the outer bag 4 such that the fasteners are adapted to overlie the portion of the outer bag having the mouth 14 defined therein. Preferably, the fasteners are connected as close as possible to the mouth 14 of the cavity 8 when the mouth is at its position within the folded condition of the outer bag 4 shown in FIGS. 2 and 3. This reduces gapping of the folded portion should the hook and loop sections 18, 20 fail. Thus, the one or more fasteners provide a safety factor over the aforementioned hook and loop sections 18, 20. The fasteners can be of any suitable type; non-limiting examples include buckles, latches, snaps, and buttons.

Referring to FIGS. 1, 2, 3 and 5, each of the illustrated fasteners of this apparatus has first and second members, specifically male and female clip members 22, 24 of a buckle 26 also having straps 28, 30, respectively. The female members 24 are shown connected to the same outside surface of the pouch as are the sections 18, 20 of hook and loop material such that ends of the members 24 are immediately adjacent the mouth 14 when the pouch is folded along the fold line 16 as shown in FIG. 2. Referring to FIG. 5 and a particular implementation, the longitudinal centers of the female members 24 are located about 3.7 inches from each edge of the sheet 10 and about four inches from the inner edges of each other; and the ends of the webbing or straps 30 opposite the members 24 are spaced about eleven inches from the nearest end of the sheet 10. Still referring to FIG. 5 and the particular implementation, the male members 22 are spaced laterally the same as the particular implementation of the female members 24 referred to above; and the male members 22 are connected at the end of the sheet 10 opposite the end where the sections 18, 20 are connected so that when the pouch is formed from the sheet 10 the male members 22 are immediately adjacent the mouth 14 but facing opposite the section 18. The longitudinal positioning of the members 22 is such to enable the members 22 to tightly engage the respective members 24 of the fasteners with the pouch folded along the fold line.

The straps 28 retaining the male members 22 are located on the outside back panel of the outer bag 4 between the fold line 16 and the mouth 14 as apparent from FIGS. 1, 2 and 5, while the female portions 24 and their webbing 30 are located on the front outer panel of the assembled outer bag 4 on the other side of the fold line 16 as also apparent from these drawings. Both components 22, 24 are in respective precise locations which allow engagement of the male portion of the buckle into the female portion of the buckle to create a positively retained buckle and a limited amount of play in the webbing to prevent significant expansion of the folded portion of the outer bag 4.

Thus, in the illustrated embodiment, final closure is accomplished using a positive means of retention. Male and female plastic clips are retained with the use of woven webbing installed through the clips and then sewn together to be an integral part of the clips. The male clips are sewn onto what can be called the top flap portion of the outer bag 14 and the female clips are sewn onto what can be called the main body portion of the bag 4. Once the top flap is folded, the male clips are then inserted into the female clips creating a positive retention assembly and along with the webbing, securely fastening the folded top portion to the remainder of the outer bag. This prevents expansion of the bag assembly from the top closure and prevents the hook and loop fasteners of the mouth closure apparatus and the fold retainer apparatus from separating.

The shipping container 2 described above can be used in implementing the method of the present invention. This is preferably a method of transporting one or more hazardous items, and more preferably the method comprises selecting the one or more hazardous items from the group consisting of diagnostic specimens, biological materials, and infectious substances, such as those referred to above.

The method generally comprises inserting one or more of the hazardous items into an inner bag, such as the inner bag 6 of the preferred embodiment shipping container 2. If the inner bag 6 is part of a primary container defined in implementing the method, the hazardous item(s) can be placed directly in the inner bag 6. If the inner bag 6 is part of a secondary container to be defined in the method, then a hazardous item is placed in a primary container which is then placed in the inner bag 6. The one or more items placed in this inner bladder bag 6 with or without cushioning or absorbent material and with or without an internal container. Once the one or more items are inside the inner bladder bag, the bag 6 is bled (such as by pushing on it) of most of the remaining air inside and then sealed in known manner along the sealing side of the bag 6 thereby creating a leakproof, pressure resistant closure. See FIG. 2 for a representation of an item 32 (an explanted hip prosthesis) inside a primary container (e.g., a plastic bag 34) inside the inner bag 6 of the present invention, which invention is serving as a secondary container in this embodiment.

Continuing with this preferred embodiment for the method of the present invention, the sealed inner bladder bag 6 is inserted through the mouth 14 of the cavity 8 and thus into the flexible outer bag 4 (see FIG. 2). The inner bag 6 is moved into the cavity 8 so that it is positioned completely below the fold line 16 of the outer bag 4. As described above, the inner bag 6 preferably has a length and width not less than the length and width of the portion of the cavity 8 below the fold line 16; therefore it will not lie completely flat within this smaller portion. Once the inner bag 6 is positioned in this manner, the outer bag 4 is closed at the mouth 14 so that the hook and loop members 13, 15 of the front and back panels meet (preferably, the outer bag 4 is first bled of air inside it, such as by pushing on it but without significantly disturbing the contents). That is, for the preferred embodiment of the shipping container 2 described above, the strip of loop material 13 and the corresponding strip of hook material 15 are aligned and engaged by pressing the two strips together to close the outer bag 4. Although this secured closure of the mouth 14 is preferred, it is contemplated that it is not a necessary step or component of the present invention as the fold retainer apparatus and the fold and mouth retainer apparatus are considered more significant.

The method still further comprises folding the one end of the outer bag 4 along the fold line 16 such that the mouth 14 is moved adjacent a portion of an outer surface of the outer bag 4 as shown in FIGS. 2 and 3. The method also comprises retaining the outer bag 4 in this folded condition. More particularly, once the mouth 14 of the outer bag 4 is closed, this end of the outer bag 4 is folded over along the fold line 16 towards the outside front panel of the outer bag 4. Just below and just above the fold line 16 are the sections 18, 20 of the hook and loop material that run across almost the entire width of the front outer panel. With the outer bag 4 folded along the fold line 16, these sections of hook and loop material align and are engaged by pressing the two sections together. This retains the folded condition of the outer bag 4.

After the fold along the line 16 is accomplished and secured using the hook and loop sections 18, 20, one or more positively retained fasteners are engaged across the mouth 14 to further secure the fold and prevent significant expansion of the outer bag opening. In the illustrated embodiment, this fastening includes connecting the respective male and female members of the buckles 26 in known manner.

With the foregoing performed in accordance with the method of the present invention, the method then further comprises shipping the retained, fastened outer bag 4 containing the inner bag 6 and one or more hazardous items by a public or private carrier. This shipping is performed in any conventional manner since the preferred embodiment shipping container 2 meets shipping requirements. This shipping can be without further outer packaging (other than as may be required by the carrier for handling and identification purposes, for example) if an exemption is obtained for the assembled shipping container 2 to act as an outer packaging and a secondary container. Otherwise, the shipping container is put in an outer packaging and then shipped. Such "outer packaging" is as that term is known in the art.

The foregoing thereby obtains and maintains an outer bag configuration which accommodates odd shaped, as well as regular shaped, objects. This outer bag configuration in turn maintains the inner bladder bag position sufficiently to remain leakproof and to resist a much greater pressure differential than the inner bladder bag alone could. The preferred embodiment of the container of the present invention is therefore a multi-component non-rigid, flexible assembly capable of meeting specific leakproof and differential pressure requirements for the transport of a number of hazardous items. The assembled container of such implementation is capable of performance significantly beyond any of its individual components alone and through its unique sequence of construction and assembly is capable of meeting performance criteria established for containers of various hazardous items.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A pressure resistant shipping container, comprising:

a flat flexible outer bag made of material having an assembled strength which is not exceeded when expansion of the outer bag occurs in response to a pressure differential of about 13.8 pounds per square inch from inside to outside the outer bag, the outer bag having a predetermined shape in an unexpanded condition and having a cavity defined therein, the cavity having a length and a width related to an area in which to receive an item to be shipped; and a flat flexible sealable inner bag made of material having a leakproof limit and an elastic limit sufficient for the inner bag to remain intact during unconstrained expansion of the inner bag caused by a pressure differential below about three pounds per square inch from inside to outside the inner bag, the inner bag having a predetermined shape in an unexpanded condition matching the predetermined shape of the outer bag but having a length in the unexpanded condition greater than the length of the area in which to receive an item to be shipped, and the inner bag also having a width in the unexpanded condition greater than the width of the area in which to receive an item to be shipped, wherein the inner bag receives an item to be shipped and further wherein the outer bag receives into the cavity the inner bag and the item received therein to form the pressure resistant shipping container.

2. A pressure resistant shipping container as defined in claim 1, wherein the outer bag includes a doubled up sheet of flexible material secured along edges extending from an integral closed edge to a mouth into the cavity of the outer bag.

3. A pressure resistant shipping container as defined in claim 2, wherein the inner bag is a plastic bag having a leakproof limit and an elastic limit which are exceeded by unconstrained expansion of the plastic bag caused by a pressure differential above about three pounds per square inch from inside the plastic bag to outside the plastic bag, but wherein the plastic bag is constrained, in response to the size of the plastic bag relative to the outer bag and the strength of the outer bag, against leakage failure and plastic deformation when the plastic bag is expanded within the outer bag in response to a pressure differential of about 13.8 pounds per square inch.

4. A pressure resistant shipping container as defined in claim 3, further comprising a fold retainer apparatus connected to the outer bag such that the fold retainer apparatus retains the outer bag in a folded condition at a fold line spaced from the mouth of the cavity when the portion of the outer bag having the mouth of the cavity is folded back over an adjacent portion of the outer bag, wherein the area in which to receive an item to be shipped is defined between the fold line and the integral closed edge of the outer bag.

5. A pressure resistant shipping container as defined in claim 4, wherein the fold retainer apparatus includes:

a section of loop material connected to one of the portions adjacent the fold line and coextensive with a majority of the length of the fold line; and a section of hook material connected to the other of the portions adjacent the fold line and coextensive with a majority of the length of the fold line.

6. A pressure resistant shipping container as defined in claim 5, further comprising a plurality of fasteners connected to the outer bag such that respective members of the fasteners are adapted to be connected together after the outer bag is in the folded condition.

7. A pressure resistant shipping container as defined in claim 6, further comprising a mouth closure apparatus connected to the outer bag at the mouth thereof.

8. A pressure resistant shipping container as defined in claim 4 further comprising a fold and mouth retainer apparatus connected to the outer bag such that the fold and mouth retainer apparatus retains the outer bag in the folded condition and the mouth in a closed position.

9. A pressure resistant shipping container as defined in claim 8, wherein the fold and mouth retainer apparatus includes a plurality of fasteners connected to the outer bag such that the fasteners are adapted to overlie the portion of the outer bag having the mouth defined therein and further such that respective members of the fasteners are adapted to be connected together after the outer bag is in the folded condition.

10. A pressure resistant shipping container as defined in claim 9, further comprising a mouth closure apparatus connected to the outer bag at the mouth thereof.

11. A shipping container, comprising:

a flat pouch defining a cavity accessible through a mouth defined in the pouch, the pouch being made of a flexible material which permits the pouch to change shape in response to the shape of an item received in the cavity of the pouch;

a fold retainer apparatus connected to the pouch such that the fold retainer apparatus retains the pouch in a folded condition at a fold line spaced from the mouth of the cavity when the portion of the pouch having the mouth is folded back over an adjacent portion of the pouch;

a fold and mouth retainer apparatus connected to the pouch such that the fold and mouth retainer apparatus extends across the mouth from a main body portion of the pouch to the folded back portion of the pouch and retains the pouch in the folded condition and the mouth in a closed position; and an inner bag adapted to receive the item and to be received in the cavity of the pouch below the fold line and removable therefrom.

12. A shipping container as defined in claim 11, wherein the fold and mouth retainer apparatus includes a fastener connected to the pouch such that the fastener overlies the portion of the pouch having the mouth defined therein and further such that respective members of the fastener connect together when the pouch is in the folded condition.

13. A shipping container as defined in claim 12, further comprising a loop member connected inside the pouch at a first side of the mouth and a hook member connected inside the pouch at a second side of the mouth facing the first side of the mouth.

14. A shipping container as defined in claim 13, wherein the fold retainer apparatus includes:

a section of loop material connected to an outside surface of the pouch at one of the portions of the pouch adjacent the fold line, the length of the section of loop material coextensive with a majority of the length of the fold line; and a section of hook material connected to the same outside surface but at the other of the portions of the pouch adjacent the fold line, the length of the section of hook material coextensive with a majority of the length of the fold line.

15. A shipping container as defined in claim 12, wherein the fold retainer apparatus includes:

a section of loop material connected to an outside surface of the pouch at one of the portions of the pouch adjacent the fold line, the length of the section of loop material coextensive with a majority of the length of the fold line; and a section of hook material connected to the same outside surface but at the other of the portions of the pouch adjacent the fold line, the length of the section of hook material coextensive with a majority of the length of the fold line.

16. A shipping container as defined in claim 15, further comprising a loop member connected inside the pouch at a first side of the mouth and a hook member connected inside the pouch at a second side of the mouth facing the first side of the mouth.

17. A shipping container as defined in claim 11, further comprising a mouth closure apparatus connected to the pouch at the mouth thereof.

18. A shipping container as defined in claim 17, wherein the mouth closure apparatus includes a loop member connected inside the pouch at a first side of the mouth and a hook member connected inside the pouch at a second side of the mouth facing the first side of the mouth.

19. A shipping container as defined in claim 11, wherein the pouch and fold retainer apparatus provide a strength which is not exceeded when the pouch expands in response to a pressure differential of about 13.8 pounds per square inch from inside the cavity to outside the pouch.

20. A shipping container as defined in claim 19, wherein the inner bag is a plastic bag having a leakproof limit and an elastic limit which are exceeded by unconstrained expansion of the plastic bag caused by a pressure differential above about three pounds per square inch from inside the plastic bag to outside the plastic bag, but wherein the plastic bag is constrained, in response to the size of the plastic bag relative to the outer bag and the strength of the pouch and fold retainer apparatus, against leakage failure and plastic deformation when the plastic bag is expanded within the pouch in the folded condition in response to a pressure differential of about 13.8 pounds per square inch.

21. A shipping container as defined in claim 20, wherein the fold retainer apparatus includes:

a section of loop material connected to an outside surface of the pouch at one of the portions of the pouch adjacent the fold line, the length of the section of loop material coextensive with a majority of the length of the fold line; and a section of hook material connected to the same outside surface but at the other of the portions of the pouch adjacent the fold line, the length of the section of hook material coextensive with a majority of the length of the fold line.

22. A shipping container as defined in claim 21, wherein the fold and mouth retainer apparatus includes a plurality of fasteners connected to the pouch such that the fasteners overlie the portion of the pouch having the mouth defined therein and further such that respective members of the fasteners connect together when the pouch is in the folded condition.

23. A shipping container as defined in claim 22, further comprising a loop member connected inside the pouch at a first side of the mouth and a hook member connected inside the pouch at a second side of the mouth facing the first side of the mouth.

24. A shipping container as defined in claim 11, wherein:

the pouch includes a doubled up sheet of flexible material secured along edges extending from an integral closed edge to the mouth of the pouch, the mouth disposed at one extreme end of the folded material;

the fold retainer apparatus includes:

a section of loop or hook material connected to an outside surface of the pouch and extending from immediately adjacent the mouth of the pouch to immediately adjacent a fold line of the pouch, the length of the section of loop or hook material coextensive with a majority of the length of the fold line; and a section of hook or loop material, complementary to the first-mentioned section of loop or hook material, connected to the same outside surface of the pouch and extending from immediately adjacent the fold line on the side thereof opposite the first-mentioned section of loop or hook material and extending away from the fold line a distance sufficient to engage with the first-mentioned section of loop or hook material when the pouch is folded along the fold line such that the mouth of the pouch is then disposed between the section of hook or loop material and the integral closed edge of the pouch, the length of the section of hook or loop material coextensive with a majority of the length of the fold line; and the fold and mouth retainer apparatus comprises at least one fastener having first and second members, the first member connected to the same outside surface of the pouch as are the sections of hook and loop material such that an end of the first member is immediately adjacent the mouth when the pouch is folded along the fold line, and the second member connected to the pouch immediately adjacent the mouth thereof opposite the first-mentioned section of loop or hook material so that the second member is disposed to tightly engage the first member of the fastener when the pouch is folded along the fold line.

25. A shipping container as defined in claim 24, further comprising a loop member connected inside the pouch at a first side of the mouth and a hook member connected inside the pouch at a second side of the mouth facing the first side of the mouth.

26. A shipping container as defined in claim 11, wherein the flat pouch is a reusable member of the shipping container and the inner bag is a non-reusable member of the shipping container.

27. A method of transporting one or more hazardous items, the method comprising:

inserting the one or more hazardous items into an inner bag;

sealing the inner bag closed;

inserting the sealed inner bag through a mouth at one end of an outer bag into a cavity of the outer bag, including moving the inner bag below a fold line at the one end of the outer bag;

folding the one end of the outer bag along the fold line such that the mouth is moved adjacent a portion of an outer surface of the outer bag and retaining the outer bag in this folded condition;

engaging fasteners connected to the outer bag and extending over the mouth in the folded condition; and shipping the retained, fastened outer bag containing the inner bag and the one or more hazardous items by a public or private carrier.

28. A method as defined in claim 27, further comprising securing the mouth closed in addition to both retaining the outer bag in the folded condition and engaging the fasteners.

29. A method as defined in claim 28, further comprising using an inner bag having a length and width not less than a length and width of the portion of the cavity below the fold line.

30. A method as defined in claim 29, further comprising selecting the one or more hazardous items from the group consisting of diagnostic specimens, biological materials, and infectious substances.

31. A method as defined in claim 27, further comprising selecting the one or more hazardous items from the group consisting of diagnostic specimens, biological materials, and infectious substances.

32. A method as defined in claim 27, further comprising selecting the one or more hazardous items from the group consisting of items within hazard classes 3, 4, 5, 6, 8 and 9.

33. A method as defined in claim 27, further comprising putting the retained, fastened outer bag containing the inner bag and the one or more hazardous items in outer packaging before shipping.

34. A method as defined in claim 33, further comprising securing the mouth closed in addition to both retaining the outer bag in the folded condition and engaging the fasteners.

35. A method as defined in claim 33, further comprising using an inner bag having a length and width greater than a length and width of the portion of the cavity below the fold line.

36. A method as defined in claim 33, further comprising selecting the one or more hazardous items from the group consisting of items within hazard classes 3, 4, 5, 6, 8 and 9.

37. A method as defined in claim 27, further comprising using an inner bag having a length and width greater than a length and width of the portion of the cavity below the fold line.

38. A pressure resistant shipping container, comprising:

a flat flexible pouch having a predetermined shape in an unexpanded condition, the pouch including first and second sides defining a cavity therebetween and a mouth into the cavity at one end of the pouch;

a fold retainer apparatus connected to the pouch such that the fold retainer apparatus retains the pouch in a folded condition in response to folding part of both sides of the pouch along a fold line spaced from the mouth of the cavity to define a fold portion of the pouch having the mouth and to define a remaining main body portion of the pouch, the fold line extending across the pouch and the fold portion including facing areas of both sides of the pouch between the fold line and the mouth so that these areas of both sides are folded over together along the fold line;

a fold and mouth retainer apparatus connected to the pouch such that the fold and mouth retainer apparatus extends across the mouth between the main body portion of the pouch and the fold portion of the pouch and retains the pouch in the folded condition and the mouth in a closed position, wherein the fold and mouth retainer apparatus includes at least one positively retained buckle that overlies the mouth and limits expansion of at least the fold portion of the pouch; and a flat flexible inner bag having a predetermined shape in an unexpanded condition with a length in the unexpanded condition greater than the length of the main body portion of the pouch and the inner bag also having a width in the unexpanded condition greater than the width of the main body portion of the pouch such that the inner bag does not lie flat in either its length direction or its width direction inside the cavity of the main body portion of the pouch, wherein the inner bag receives an item to be shipped and further wherein the outer bag receives into the cavity of the main body portion of the pouch the inner bag and the item received therein.

39. A pressure resistant shipping container as defined in claim 38, wherein the pouch includes an outer laminated high tensile woven material.

40. A pressure resistant shipping container as defined in claim 29, wherein the inner bag includes co-extruded, 3.5 mil plastic material.

41. A pressure resistant shipping container as defined in claim 1, wherein the material of the outer bag includes an outer laminated high tensile woven material.

42. A pressure resistant shipping container as defined in claim 41, wherein the material of the inner bag includes co-extruded, 3.5 mil plastic.

43. A shipping container as defined in claim 11, wherein the fold and mouth retainer apparatus includes a mechanical positive locking mechanism that retains the pouch to limit expansion of the cavity in the pouch.

* * * * *

UNITED STATES PATENT AND TRADEMARK OFFICE

CERTIFICATE OF CORRECTION

PATENT NO. : 5,996,799

DATED : December 7, 1999

INVENTOR(S) : Ralph H. Garreth and Barry E. Johnston

It is certified that error appears in the above-identified patent and that said Letters Patent is hereby corrected as shown below:

Column 5, line 8, after "(FIGS. 1-3" insert --)--.

Column 5, line 11, after "cavity" insert --8--.

Column 9, line 13, after "items" insert --are--.

Column 12, line 36, in the first line of claim 15, change "12" to --11--.

Column 16, line 17, in the second line of claim 40, change "29" to --39--.

Signed and Sealed this

Twenty-sixth Day of September, 2000

*Attest:*

Q. TODD DICKINSON

*Attesting Officer*

*Director of Patents and Trademarks*